US012473607B2

(12) United States Patent
Kitsuya et al.

(10) Patent No.: US 12,473,607 B2
(45) **Date of Patent: *Nov. 18, 2025**

(54) ABRASION-RESISTANT STEEL PLATE AND METHOD OF PRODUCING ABRASION-RESISTANT STEEL PLATE

(71) Applicant: JFE STEEL CORPORATION, Tokyo (JP)

(72) Inventors: Shigeki Kitsuya, Tokyo (JP); Hitoshi Sueyoshi, Tokyo (JP); Tomoyuki Yokota, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 519 days.

This patent is subject to a terminal disclaimer.

(21) Appl. No.: 17/999,585

(22) PCT Filed: May 25, 2021

(86) PCT No.: PCT/JP2021/019889

§ 371 (c)(1),
(2) Date: Nov. 22, 2022

(87) PCT Pub. No.: WO2021/241605

PCT Pub. Date: Dec. 2, 2021

(65) Prior Publication Data

US 2023/0203614 A1 Jun. 29, 2023

(30) Foreign Application Priority Data

May 28, 2020 (JP) ..... 2020-093664

(51) Int. Cl.

| | |
|---|---|
| ***C21D 9/00*** | (2006.01) |
| ***C21D 1/18*** | (2006.01) |
| ***C21D 6/00*** | (2006.01) |
| ***C21D 8/02*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(Continued)

(52) U.S. Cl.

CPC ..... *C21D 9/0081* (2013.01); *C21D 1/18* (2013.01); *C21D 6/002* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0263* (2013.01); *C22C 33/04* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/008* (2013.01)

(58) Field of Classification Search

None

See application file for complete search history.

(56) References Cited

U.S. PATENT DOCUMENTS

2009/0126836 A1 5/2009 Kariya et al.
2019/0309384 A1 10/2019 Terazawa et al.

FOREIGN PATENT DOCUMENTS

CN 109072366 A 12/2018
CN 109136482 A * 1/2019 ..... C22C 33/04

(Continued)

OTHER PUBLICATIONS

Dec. 7, 2023, Office Action issued by the China National Intellectual Property Administration in the corresponding Chinese Patent Application No. 202180037488.3 with English language concise statement of relevance.

(Continued)

*Primary Examiner* — Jenny R Wu

(74) *Attorney, Agent, or Firm* — KENJA IP LAW PC

(57) ABSTRACT

Provided is an abrasion-resistant steel plate excellent in both abrasion resistance and wide bending workability. An abrasion-resistant steel plate comprises a specific chemical composition, wherein a volume fraction of martensite at a depth of 1 mm from a surface of the abrasion-resistant steel plate is 90% or more, hardness at a depth of 1 mm from the surface is 500 HBW 10/3000 to 650 HBW 10/3000 in Brinell hardness, and a transverse direction hardness difference is 30Hv10 or less in Vickers hardness, the transverse direction hardness difference being defined as a difference in the hardness at a depth of 1 mm from the surface between two points adjacent at intervals of 10 mm in a transverse direction of the abrasion-resistant steel plate.

10 Claims, No Drawings

(51) Int. Cl.
*C22C 38/52* (2006.01)
*C22C 38/54* (2006.01)

(56) References Cited

FOREIGN PATENT DOCUMENTS

| | | | | |
|---|---|---|---|---|
| EP | 2103697 | A1 | | 9/2009 |
| JP | S63169359 | A | | 7/1988 |
| JP | S6431928 | A | | 2/1989 |
| JP | H06306537 | A | | 11/1994 |
| JP | H0790477 | A | | 4/1995 |
| JP | 2000212688 | A | * | 8/2000 |
| JP | 2006104489 | A | | 4/2006 |
| JP | 2008169443 | A | | 7/2008 |
| JP | 2013139630 | A | | 7/2013 |
| JP | 2013147741 | A | | 8/2013 |
| JP | 2018059187 | A | | 4/2018 |
| JP | 2018059188 | A | | 4/2018 |
| JP | 2018059189 | A | * | 4/2018 |
| KR | 1020190077916 | A | | 7/2019 |
| WO | 2008081956 | A1 | | 7/2008 |

OTHER PUBLICATIONS

Jul. 13, 2023, Office Action issued by the China National Intellectual Property Administration in the corresponding Chinese Patent Application No. 202180037488.3 with English language search report.

Oct. 16, 2023, Office Action issued by the IP Australia in the corresponding Australian Patent Application No. 2021280575.

Aug. 17, 2021, International Search Report issued in the International Patent Application No. PCT/JP2021/019889.

Feb. 22, 2022, Notification of Reasons for Refusal issued by the Japan Patent Office in the corresponding Japanese Patent Application No. 2021-552225 with English language Concise Statement of Relevance.

Aug. 12, 2024, Office Action issued by the Korean Intellectual Property Office in the corresponding Korean Patent Application No. 10-2022-7040252 with English language concise statement of relevance.

* cited by examiner

ABRASION-RESISTANT STEEL PLATE AND METHOD OF PRODUCING ABRASION-RESISTANT STEEL PLATE

TECHNICAL FIELD

The present disclosure relates to an abrasion-resistant steel plate, and particularly relates to an abrasion-resistant steel plate having excellent wide bending workability and suitable for members of industrial machinery and transportation equipment used in the fields of construction, civil engineering, mining, etc. The present disclosure also relates to a method of producing the abrasion-resistant steel plate. The term "wide bending workability" herein denotes bending workability for a steel plate width of 200 mm or more, which is an issue in actual use.

BACKGROUND

It is known that the abrasion resistance of a steel material is improved by increasing its hardness. Hence, steel materials subjected to heat treatment such as quenching to have higher hardness are used in members exposed to abrasion by earth and sand, rocks, and the like.

For example, JP S63-169359 A (PTL 1) describes a method of producing an abrasion-resistant steel plate by hot rolling a steel material having a specific chemical composition to obtain a steel plate and then quenching the steel plate. With the method described in PTL 1, by controlling the contents of C, alloying elements, and N, an abrasion-resistant steel plate that has a hardness of 340 HB or more and high toughness as quenched and has improved weld low-temperature cracking resistance is obtained.

JP S64-031928 A (PTL 2) describes a method of producing an abrasion-resistant steel plate by hot rolling a steel having a specific chemical composition at a temperature of 900° C. to Ar3 transformation point with a reduction ratio of 15% or more and then direct quenching the obtained steel plate from a temperature of Ar3 transformation point or more. With the method described in PTL 2, by controlling the chemical composition and the quenching conditions, an abrasion-resistant steel plate having high hardness can be obtained easily.

The respective techniques described in PTL 1 and PTL 2 improve the abrasion resistance by increasing the hardness. Meanwhile, there is also a growing demand for abrasion-resistant steels excellent not only in abrasion resistance but also in bending workability, for application to members of various shapes and reduction of welded portions.

In response to such demand, for example, JP H07-090477 A (PTL 3) proposes an abrasion-resistant steel containing, in wt %, C: 0.05% to 0.20%, Mn: 0.50% to 2.5%, and Al: 0.02% to 2.00% and having an area fraction of martensite of 5% or more and 50% or less. According to PTL 3, a hot-rolled steel is heated to a temperature in a ferrite-austenite dual phase region between Ac1 point and Ac3 point and then rapidly cooled to control the area fraction of martensite, as a result of which an abrasion-resistant steel having excellent workability and weldability is obtained.

JP 2006-104489 A (PTL 4) proposes a method of producing an abrasion-resistant steel plate by hot rolling a steel having a specific chemical composition, then immediately cooling the obtained steel plate to Ms point±25° C., stopping the cooling and recuperating the steel plate to Ms point+50° C. or more, and then cooling the steel plate to room temperature. According to PTL 4, the minimum hardness in a region from the surface to 5 mm in depth of the steel plate obtained by this production method is at least 40 HV less than the maximum hardness in a more internal region of the steel plate, and thus the bending workability is improved.

JP 2008-169443 A (PTL 5) proposes a method of producing an abrasion-resistant steel plate by hot rolling a steel having a specific chemical composition with DI* (quench hardenability index) of 60 or more and then cooling the obtained steel plate to a temperature range of 400° C. or less at an average cooling rate of 0.5° C./s to 2° C./s. According to PTL 5, 400 particles/mm$^2$ or more of Ti-based carbide with an average particle size of 0.5 μm to 50 μm precipitate in the abrasion-resistant steel plate obtained by this production method, and thus abrasion-resistant steel having excellent abrasion resistance and bending workability is obtained without heat treatment.

CITATION LIST

Patent Literature

PTL 1: JP S63-169359 A
PTL 2: JP S64-031928 A
PTL 3: JP H07-090477 A
PTL 4: JP 2006-104489 A
PTL 5: JP 2008-169443 A

SUMMARY

Technical Problem

As described in PTL 3 to PTL 5, the conventional methods of improving the bending workability of an abrasion-resistant steel plate are based on the concept that, while ensuring the bending workability by limiting the hardness of the matrix of the steel plate, the abrasion resistance is improved by microstructure control or carbide precipitation. With such methods, it is difficult to sufficiently improve the hardness of the matrix, making it impossible to achieve both the abrasion resistance and the bending workability.

Given that the demand level of abrasion resistance is increasing year by year, there is a need for a technique capable of achieving both the abrasion resistance and the bending workability, which are mutually contradictory properties, at high level.

When working an abrasion-resistant steel plate to produce a finished product such as a member for civil engineering and construction equipment, bending work is typically performed under a condition that the plate width of the abrasion-resistant steel plate is 200 mm or more. Since bending cracks are usually more likely to occur when the plate width is wider, a steel plate with a plate width of 200 mm or more needs to be used to evaluate the bending workability of the steel plate in actual use. The bending workability for a plate width of 200 mm or more is, however, not taken into consideration in the foregoing conventional techniques.

It could therefore be helpful to provide an abrasion-resistant steel plate excellent in both abrasion resistance and bending workability which are mutually contradictory properties. With regard to the bending workability, in particular, it could be helpful to provide an abrasion-resistant steel plate having excellent bending workability under a severe condition that the steel plate width is 200 mm or more (hereafter referred to as "wide bending workability").

Solution to Problem

We studied each factor that influences the wide bending workability of an abrasion-resistant steel plate, and consequently discovered the following (1) to (4).

(1) The bending workability of the abrasion-resistant steel plate is significantly influenced by the hardness and ductility of the surface layer of the abrasion-resistant steel plate.

(2) In particular, if the abrasion-resistant steel plate has a locally hardened zone or softened zone, strain concentrates around the softened zone or hardened zone and the ductility decreases, so that the wide bending workability decreases.

(3) By reducing the difference in hardness in the abrasion-resistant steel plate, the wide bending workability can be improved without decreasing the hardness of the matrix which significantly affects the abrasion resistance.

(4) In the production of the abrasion-resistant steel plate, by performing quenching from the austenite temperature range and reducing the difference in cooling rate in the transverse direction of the steel plate during the quenching, the difference in hardness in the abrasion-resistant steel plate can be reduced.

The present disclosure is based on these discoveries and further studies. We thus provide the following.

1. An abrasion-resistant steel plate comprising a chemical composition containing (consisting of), in mass %, C: more than 0.30% and 0.45% or less, Si: 0.05% to 1.00%, Mn: 0.50% to 2.00%, P: 0.020% or less, S: 0.010% or less, Al: 0.01% to 0.06%, Cr: 0.10% to 1.00%, and N: 0.0100% or less, with a balance consisting of Fe and inevitable impurities, wherein a volume fraction of martensite at a depth of 1 mm from a surface of the abrasion-resistant steel plate is 90% or more, hardness at a depth of 1 mm from the surface is 500 HBW 10/3000 to 650 HBW 10/3000 in Brinell hardness, and a transverse direction hardness difference is 30Hv10 or less in Vickers hardness, the transverse direction hardness difference being defined as a difference in the hardness at a depth of 1 mm from the surface between two points adjacent at intervals of 10 mm in a transverse direction of the abrasion-resistant steel plate.

2. The abrasion-resistant steel plate according to 1., wherein the chemical composition further contains, in mass %, one or more selected from the group consisting of Nb: 0.005% to 0.020%, Ti: 0.005% to 0.020%, and B: 0.0003% to 0.0030%.

3. The abrasion-resistant steel plate according to 1, or 2., wherein the chemical composition further contains, in mass %, one or more selected from the group consisting of Cu: 0.01% to 0.5%, Ni: 0.01% to 3.0%, Mo: 0.1% to 1.0%, V: 0.01% to 0.10%, W: 0.01% to 0.5%, and Co: 0.01% to 0.5%.

4. The abrasion-resistant steel plate according to any one of 1. to 3., wherein the chemical composition further contains, in mass %, one or more selected from the group consisting of Ca: 0.0005% to 0.0050%, Mg: 0.0005% to 0.0100%, and REM: 0.0005% to 0.0200%.

5. A method of producing an abrasion-resistant steel plate, the method comprising: heating a steel material to a heating temperature that is an Ac3 transformation point or more and 1300° C. or less, the steel material having a chemical composition containing, in mass %, C: more than 0.30% and 0.45% or less, Si: 0.05% to 1.00%, Mn: 0.50% to 2.00%, P: 0.020% or less, S: 0.010% or less, Al: 0.01% to 0.06%, Cr: 0.10% to 1.00%, and N: 0.0100% or less, with a balance consisting of Fe and inevitable impurities; hot rolling the heated steel material to obtain a hot-rolled steel plate; and subjecting the hot-rolled steel plate to quenching, wherein the quenching is (a) direct quenching of cooling the hot-rolled steel plate from a cooling start temperature that is an Ar3 transformation point or more to a cooling stop temperature that is a Mf point or less or (b) reheating quenching of cooling the hot-rolled steel plate, reheating the cooled hot-rolled steel plate to a reheating temperature that is the Ac3 transformation point or more and 950° C. or less, and cooling the reheated hot-rolled steel plate from the reheating temperature to a cooling stop temperature that is the Mf point or less, and in a cooling process in the quenching, a difference in average cooling rate between a center position and a ¼ position of the hot-rolled steel plate in the transverse direction and a difference in average cooling rate between the center position and a ¾ position of the hot-rolled steel plate in the transverse direction are each 5° C./s or less.

The method of producing an abrasion-resistant steel plate according to 5., wherein the cooling stop temperature in the quenching is less than (Mf point−100° C.), and the method comprises, after the quenching, tempering the quenched hot-rolled steel plate at a tempering temperature that is (Mf point−80° C.) or more and (Mf point+50° C.) or less.

7. The method of producing an abrasion-resistant steel plate according to 6., wherein in the tempering, the quenched hot-rolled steel plate is held at the tempering temperature for 60 s or more.

8. The method of producing an abrasion-resistant steel plate according to 6, or 7., wherein an average heating rate in the tempering is 2° C./s or more.

9. The method of producing an abrasion-resistant steel plate according to 5., wherein the cooling stop temperature in the quenching is Mf point or less and (Mf point−100° C.) or more, and the method comprises, after the quenching, air cooling the quenched hot-rolled steel plate.

10. The method of producing an abrasion-resistant steel plate according to any one of 5. to 9., wherein the chemical composition further contains, in mass %, one or more selected from the group consisting of Nb: 0.005% to 0.020%, Ti: 0.005% to 0.020%, and B: 0.0003% to 0.0030%.

11. The method of producing an abrasion-resistant steel plate according to any one of 5. to 10., wherein the chemical composition further contains, in mass %, one or more selected from the group consisting of Cu: 0.01% to 0.5%, Ni: 0.01% to 3.0%, Mo: 0.1% to 1.0%, V: 0.01% to 0.10%, W: 0.01% to 0.5%, and Co: 0.01% to 0.5%.

12. The method of producing an abrasion-resistant steel plate according to any one of 5. to 11., wherein the chemical composition further contains, in mass %, one or more selected from the group consisting of Ca: 0.0005% to 0.0050%, Mg: 0.0005% to 0.0100%, and REM: 0.0005% to 0.0200%.

Advantageous Effect

It is thus possible to produce an abrasion-resistant steel plate excellent in both abrasion resistance and wide bending workability. Since excellent wide bending workability can be achieved without a decrease in hardness which affects the abrasion resistance, high demand level of abrasion resistance in recent years can be satisfied. The abrasion-resistant steel plate according to the present disclosure is therefore suitable as material for members of industrial machinery and transportation equipment used in the fields of construction, civil engineering, mining, etc.

DETAILED DESCRIPTION

The following will describe embodiments of the present disclosure in detail. The following description shows examples of preferred embodiments of the present disclosure and does not limit the scope of the present disclosure.

[Chemical Composition]

In the present disclosure, it is important that an abrasion-resistant steel plate and a steel material used in the production of the abrasion-resistant steel plate have the above-described chemical composition. First, the reasons for limiting the chemical composition of the steel as described above in the present disclosure will be described below. Herein, "%" with regard to the chemical composition is mass % unless otherwise stated.

C: More than 0.30% and 0.45% or Less

C is an element that increases the hardness of the matrix and improves the abrasion resistance. To achieve this effect, the C content is more than 0.30%. The C content is preferably 0.35% or more. If the C content is more than 0.45%, the hardness of the matrix increases excessively, and the wide bending workability greatly decreases. The C content is therefore 0.45% or less. The C content is preferably 0.43% or less.

Si: 0.05% to 1.00%

Si is an element that acts as a deoxidizer. Si also has the effect of increasing the hardness of the matrix by solid solution strengthening in the steel. If the Si content is less than 0.05%, the deoxidizing effect is insufficient and the amount of inclusions increases, and as a result the ductility decreases. The Si content is therefore 0.05% or more. The Si content is preferably 0.10% or more, and more preferably 0.20% or more. If the Si content is more than 1.00%, the amount of inclusions increases and the ductility decreases, and as a result the wide bending workability decreases. The Si content is therefore 1.00% or less. The Si content is preferably 0.80% or less, and more preferably 0.60% or less.

Mn: 0.50% to 2.00%

Mn is an element that increases the hardness of the matrix and improves the abrasion resistance. If the Mn content is less than 0.50%, the quench hardenability is insufficient, and uniform hardness cannot be achieved. The Mn content is therefore 0.50% or more. The Mn content is preferably 0.60% or more, and more preferably 0.70% or more. If the Mn content is more than 2.00%, the hardness increases excessively, so that the wide bending workability decreases. The Mn content is therefore 2.00% or less. The Mn content is preferably 1.80% or less, and more preferably 1.60% or less.

P: 0.020% or Less

P is an element contained as an inevitable impurity, and has an adverse effect such as segregating to grain boundaries and acting as a fracture origin. Accordingly, it is desirable to reduce the P content as much as possible, but 0.020% or less is acceptable. Although no lower limit is placed on the P content, reducing the P content to less than 0.001% is difficult in industrial scale production. Hence, the P content is preferably 0.001% or more from the viewpoint of productivity.

S: 0.010% or Less

S is an element contained as an inevitable impurity, and has an adverse effect such as existing in the steel as a sulfide-based inclusion such as MnS and acting as a fracture origin. Accordingly, it is desirable to reduce the S content as much as possible, but 0.010% or less is acceptable. Although no lower limit is placed on the S content, reducing the S content to less than 0.0001% is difficult in industrial scale production. Hence, the S content is preferably 0.0001% or more from the viewpoint of productivity.

Al: 0.01% to 0.06%

Al is an element that acts as a deoxidizer and also has the effect of forming nitride to refine crystal grains and improve the ductility. To achieve these effects, the Al content is 0.01% or more. If the Al content is more than 0.06%, nitride forms excessively and surface defects increase. If the Al content is more than 0.06%, oxide-based inclusions increase and the ductility decreases, as a result of which the wide bending workability decreases. The Al content is therefore 0.06% or less. The Al content is preferably 0.05% or less, and more preferably 0.04% or less.

Cr: 0.10% to 1.00%

Cr is an element that has the effect of increasing the hardness of the matrix and improving the abrasion resistance. If the Cr content is less than 0.10%, the quench hardenability improving effect by adding Cr cannot be achieved, and uniform hardness cannot be obtained. The Cr content is therefore 0.10% or more. The Cr content is preferably 0.20% or more, and more preferably 0.25% or more. If the Cr content is more than 1.00%, the ductility decreases due to precipitate formation, and the wide bending workability decreases. The Cr content is therefore 1.00% or less. The Cr content is preferably 0.85% or less, and more preferably 0.80% or less.

N: 0.0100% or less

N is an element contained as an inevitable impurity, and forms nitride and the like and thus contributes to the refinement of crystal grains. If the precipitate formation is excessive, however, the ductility decreases and the wide bending workability decreases. The N content is therefore 0.0100% or less. The N content is preferably 0.0060% or less, and more preferably 0.0040% or less. Although no lower limit is placed on the N content, reducing the N content to less than 0.0010% is difficult in industrial scale production. Hence, the N content is preferably 0.0010% or more from the viewpoint of productivity.

The abrasion-resistant steel plate and the steel material according to one embodiment of the present disclosure have a chemical composition containing the above-described components with the balance consisting of Fe and inevitable impurities.

In another embodiment of the present disclosure, the chemical composition may optionally further contain one or more selected from the group consisting of Nb: 0.005% to 0.020%, Ti: 0.005% to 0.020%, and B: 0.0003% to 0.0030%.

Nb: 0.005% to 0.020%

Nb is an element that increases the hardness of the matrix and contributes to further improvement in abrasion resistance. Nb also forms carbonitride and refines prior austenite grains. In the case of adding Nb, to achieves these effects, the Nb content is 0.005% or more, and preferably 0.007% or more. If the Nb content is more than 0.020%, NbC precipitates in large amount and the ductility decreases, as a result of which the wide bending workability decreases. Accordingly, in the case of adding Nb, the Nb content is 0.020% or less. The Nb content is preferably 0.018% or less.

Ti: 0.005% to 0.020%

Ti is an element that forms nitride in the steel and refines prior austenite grains to thus improve the ductility. In the case where Ti and B coexist, as a result of Ti fixing N, the precipitation of BN is suppressed, with it being possible to enhance the quench hardenability improvement effect by B. In the case of adding Ti, to achieve these effects, the Ti content is 0.005% or more. The Ti content is preferably 0.007% or more. If the Ti content is more than 0.020%, hard TiC precipitates in large amount, causing a decrease in wide bending workability. Accordingly, in the case of adding Ti, the Ti content is 0.020% or less. The Ti content is preferably 0.015% or less.

B: 0.0003% to 0.0030%

B is an element that greatly improves the quench hardenability even when added in small amount. By adding B, the formation of martensite can be promoted and the abrasion resistance can be improved more effectively. In the case of adding B, to achieve this effect, the B content is 0.0003% or more. The B content is preferably 0.0005% or more, and more preferably 0.0008% or more. If the B content is more than 0.0030%, an adverse effect such as forming a large amount of precipitates, such as boride, that act as a fracture origin occurs. Accordingly, in the case of adding B, the B content is 0.0030% or less. The B content is preferably 0.0015% or less.

In another embodiment of the present disclosure, the chemical composition may optionally further contain one or more selected from the group consisting of Cu: 0.01% to 0.5%, Ni: 0.01% to 3.0%, Mo: 0.1% to 1.0%, V: 0.01% to 0.10%, W: 0.01% to 0.5%, and Co: 0.01% to 0.5%.

Cu: 0.01% to 0.5%

Cu is an element that improves the quench hardenability, and may be optionally added in order to further improve the hardness. In the case of adding Cu, to achieve this effect, the Cu content is 0.01% or more. If the Cu content is more than 0.5%, surface defects tend to occur, causing a decrease in productivity. Moreover, the alloy cost increases. Accordingly, in the case of adding Cu, the Cu content is 0.5% or less.

Ni: 0.01% to 3.0%

Ni is an element that improves the quench hardenability, and may be optionally added in order to further improve the hardness. In the case of adding Ni, to achieve this effect, the Ni content is 0.01% or more. If the Ni content is more than 3.0%, the alloy cost increases. Accordingly, the Ni content is 3.0% or less.

Mo: 0.1% to 1.0%

Mo is an element that improves the quench hardenability, and may be optionally added in order to further improve the hardness. In the case of adding Mo, to achieve this effect, the Mo content is 0.1% or more. If the Mo content is more than 1.0%, the weldability degrades and the alloy cost increases. Accordingly, in the case of adding Mo, the Mo content is 1.0% or less.

V: 0.01% to 0.10%

V is an element that improves the quench hardenability, and may be optionally added in order to further improve the hardness. V also precipitates as VN and thus contributes to the reduction of solute N. In the case of adding V, to achieve these effects, the V content is 0.01% or more. If the V content is more than 0.10%, hard VC precipitates, causing a decrease in ductility. Accordingly, in the case of adding V, the V content is 0.10% or less, preferably 0.08% or less, and more preferably 0.05% or less.

W: 0.01% to 0.5%

W is an element that improves the quench hardenability as with Mo, and may be optionally added. In the case of adding W, to achieve this effect, the W content is 0.01% or more. If the W content is more than 0.5%, the alloy cost increases. Accordingly, in the case of adding W, the W content is 0.5% or less.

Co: 0.01% to 0.5%

Co is an element that improves the quench hardenability, and may be optionally added. In the case of adding Co, to achieve this effect, the Co content is 0.01% or more. If the Co content is more than 0.5%, the alloy cost increases. Accordingly, in the case of adding Co, the Co content is 0.5% or less.

In another embodiment of the present disclosure, the chemical composition may optionally further contain one or more selected from the group consisting of Ca: 0.0005% to 0.0050%, Mg: 0.0005% to 0.0100%, and REM: 0.0005% to 0.0200%.

Ca: 0.0005% to 0.0050%

Ca is an element useful for morphological control of sulfide-based inclusions, and may be optionally added. To achieve this effect, the Ca content needs to be 0.0005% or more. Accordingly, in the case of adding Ca, the Ca content is 0.0005% or more. If the Ca content is more than 0.0050%, the ductility decreases due to an increase in the amount of inclusions in the steel, as a result of which the wide bending workability decreases. Accordingly, in the case of adding Ca, the Ca content is 0.0050% or less, and preferably 0.0025% or less.

Mg: 0.0005% to 0.0100%

Mg is an element that forms stable oxide at high temperature to effectively suppress coarsening of prior austenite grains and improve the ductility. To achieve this effect, the Mg content needs to be 0.0005% or more. Accordingly, in the case of adding Mg, the Mg content is 0.0005% or more. If the Mg content is more than 0.0100%, the ductility decreases due to an increase in the amount of inclusions in the steel, as a result of which the wide bending workability decreases. Accordingly, in the case of adding Mg, the Mg content is 0.0100% or less, and preferably 0.0050% or less.

REM: 0.0005% to 0.0200%

REM (rare earth metal) has the effect of forming oxide and sulfide in the steel and improving the material properties, as with Ca. To achieve this effect, the REM content needs to be 0.0005% or more. Accordingly, in the case of adding REM, the REM content is 0.0005% or more. If the REM content is more than 0.0200%, the effect is saturated. Accordingly, in the case of adding REM, the REM content is 0.0200% or less, and preferably 0.0100% or less.

[Microstructure]

Volume Fraction of Martensite: 90% or More

In the present disclosure, the volume fraction of martensite at a depth of 1 mm from the surface of the abrasion-resistant steel plate is 90% or more. If the volume fraction of martensite is less than 90%, the hardness of the matrix of the abrasion-resistant steel plate decreases, so that the abrasion resistance degrades. The volume fraction of martensite is therefore 90% or more. Since a higher volume fraction of martensite is better, no upper limit is placed on the volume fraction, and the volume fraction may be 100%. The volume fraction of martensite can be measured by the method described in the EXAMPLES section.

If the volume fraction of martensite is 90% or more, the desired abrasion resistance can be achieved regardless of the residual microstructure. Hence, the residual microstructure other than martensite is not limited, and may be any microstructure. For example, the residual microstructure may be one or more selected from the group consisting of ferrite, pearlite, austenite, and bainite.

[Hardness]

Brinell Hardness: 500 HBW 10/3000 to 650 HBW 10/3000

In addition to having the foregoing chemical composition, the abrasion-resistant steel plate according to the present disclosure has a hardness of 500 HBW 10/3000 to 650 HBW 10/3000 in Brinell hardness at a depth of 1 mm from the surface. The reasons for limiting the surface hardness will be described below.

The abrasion resistance of the steel plate can be improved by increasing the hardness of the surface layer of the steel plate. If the hardness at a depth of 1 mm from the surface of the steel plate is less than 500 HBW in Brinell hardness, sufficient abrasion resistance cannot be achieved, leading to a shorter use life. Accordingly, the hardness at a depth of 1 mm from the surface of the steel plate is 500 HBW or more in Brinell hardness. If the hardness at a depth of 1 mm from the surface of the steel plate is more than 650 HBW in Brinell hardness, the wide bending workability degrades. Accordingly, the hardness at a depth of 1 mm from the surface of the steel plate is 650 HBW or less in Brinell hardness. The Brinell hardness herein is the value (HBW 10/3000) measured at a position of ¼ of the plate width using a tungsten hard ball of 10 mm in diameter with a load of 3000 kgf.

[Transverse Direction Hardness Difference]

Transverse Direction Hardness Difference: 30Hv10 or Less

If the abrasion-resistant steel plate has a locally hardened zone or softened zone, strain concentrates around the softened zone or hardened zone and the ductility decreases, so that excellent wide bending workability cannot be achieved. In view of this, in the present disclosure, the transverse direction hardness difference is 30Hv10 or less in Vickers hardness. The transverse direction hardness difference herein is defined as the difference in hardness at a depth of 1 mm from the surface of the abrasion-resistant steel plate between two points adjacent at intervals of 10 mm in the plate transverse direction. As a result of the hardness difference being in this range, favorable bending property can be achieved even in wide bending work. Since a steel plate is typically produced while being moved in the rolling direction, if uniformity is maintained in the transverse direction (i.e., the direction orthogonal to the rolling direction), uniformity is equally maintained in the rolling direction.

The transverse direction hardness difference can be evaluated by, at a depth position of 1 mm from the surface of the abrasion-resistant steel plate, performing Vickers hardness measurement at intervals of 10 mm in the transverse direction and calculating the difference in hardness between adjacent measurement points. The expression "the transverse direction hardness difference is 30Hv10 or less" means that the hardness difference between every pair of adjacent points is 30Hv10 or less, that is, the maximum hardness difference between adjacent two points is 30Hv10 or less.

For cutting of an abrasion-resistant steel plate, thermal cutting such as gas cutting, plasma cutting, or laser cutting is typically used. In the thermally cut abrasion-resistant steel plate, the hardness at edge parts has changed due to the influence of heat during the cutting. Hence, the heat-affected zones at the edge parts of the abrasion-resistant steel plate are excluded from the measurement of the transverse direction hardness difference. In detail, the Vickers hardness measurement is performed at intervals of 10 mm in the transverse direction except a region of 50 mm on each end of the abrasion-resistant steel plate. The transverse direction hardness difference can thus be determined.

If the measurement is performed at intervals greater than 10 mm, a hardness change that causes degradation in bending workability cannot be detected. If the measurement intervals are shorter, the hardness change detection accuracy increases, but the number of measurement points is enormous. Moreover, it was demonstrated that excellent performance can be actually achieved by controlling the hardness difference measured at intervals of 10 mm, as described in the EXAMPLES section below. For these reasons, the measurement interval is 10 mm.

[Plate Thickness]

The plate thickness of the abrasion-resistant steel plate according to the present disclosure is not limited, and may be any plate thickness. Given that abrasion-resistant steel plates of 4 mm to 60 mm in plate thickness are particularly required to have wide bending workability, the plate thickness of the abrasion-resistant steel plate is preferably 4 mm to 60 mm.

[Production Method]

A method of producing an abrasion-resistant steel plate according to one embodiment of the present disclosure will be described below. The abrasion-resistant steel plate according to the present disclosure can be produced by heating a steel material having the foregoing chemical composition, hot rolling the steel material, and then subjecting the obtained steel plate to heat treatment including quenching under the below-described conditions.

[Steel Material]

As the steel material, any form of material may be used. For example, the steel material may be a steel slab.

The method of producing the steel material is not limited. For example, the steel material can be produced by smelting a molten steel having the foregoing chemical composition by a conventional method and casting the steel. The smelting may be performed by any method such as a converter, an electric furnace, or an induction furnace. The casting is preferably performed by continuous casting from the viewpoint of productivity, but may be performed by ingot casting.

[Heating]

The steel material is heated to a heating temperature prior to hot rolling. The heating may be performed after cooling the steel material obtained by casting and the like. Alternatively, the obtained steel material may be directly heated without cooling.

Heating Temperature: Ac3 Transformation Point or More and 1300° C. Or Less

If the heating temperature is less than Ac3 transformation point, ferrite phase is contained in the microstructure of the steel plate after the heating. In such a case, not only sufficient hardness cannot be achieved after quenching, but also uniform microstructure cannot be obtained. The heating temperature is therefore Ac3 transformation point or more. If the heating temperature is more than 1300° C., an excessive amount of energy is needed in the heating, which causes a decrease in productivity. The heating temperature is therefore 1300° C. or less, preferably 1250° C. or less, more preferably 1200° C. or less, and further preferably 1150° C. or less.

Ac3 transformation point can be calculated using the following formula:

$$Ac3\ (^\circ C.)=912.0-230.5\times C+31.6\times Si-20.4\times Mn-39.8\times Cu-18.1\times Ni-14.8\times Cr+16.8\times Mo$$

where each element symbol in the formula represents the content of the corresponding element in mass %, with the content of each element not contained being 0.

[Hot Rolling]

The heated steel material is then hot rolled to obtain a hot-rolled steel plate. The hot rolling conditions are not limited, and the hot rolling may be performed by a conventional method. In the present disclosure, the hardness, etc. of the steel plate are controlled in the heat treatment process after the hot rolling, and accordingly the hot rolling conditions are not limited. However, from the viewpoint of decreasing the deformation resistance of the steel material and reducing the load on the mill, the rolling finish temperature is preferably 750° C. or more, more preferably 800° C. or more, and further preferably 850° C. or more. From the viewpoint of preventing significant coarsening of austenite grains and the resulting decrease in ductility after the heat treatment, the rolling finish temperature is preferably 1000° C. or less and more preferably 950° C. or less.

In the present disclosure, the hot-rolled steel plate is subjected to heat treatment including quenching. The heat treatment may be performed by any method of the below-described two embodiments. In the following description, the term "cooling start temperature" refers to the surface temperature of the steel plate at the cooling start in the cooling process in quenching, and the term "cooling stop temperature" refers to the surface temperature of the steel plate at the cooling end in the cooling process in quenching.

In one embodiment of the present disclosure, after the hot rolling, the obtained hot-rolled steel plate is subjected to quenching. The quenching is performed by (a) direct quenching (DQ) or (b) reheating quenching (RQ). Although the method of cooling in the quenching is not limited, water cooling is preferable.

(a) Direct Quenching (DQ)

In the case of performing the quenching by direct quenching, the hot-rolled steel plate after the hot rolling is cooled from a cooling start temperature that is Ar3 transformation point or more to a cooling stop temperature that is Mf point or less.

Cooling Start Temperature: Ar3 Transformation Point or More

If the cooling start temperature is Ar3 transformation point or more, the quenching starts from the austenite region, so that the desired martensite microstructure can be obtained. If the cooling start temperature is less than Ar3 point, ferrite forms, causing the volume fraction of martensite in the finally obtained microstructure to be less than 90%. If the volume fraction of martensite is less than 90%, the hardness of the steel plate cannot be improved sufficiently, and consequently the abrasion resistance of the steel plate decreases. Moreover, if the cooling start temperature is less than Ar3 point, a difference in hardness occurs in the transverse direction, so that the wide bending workability decreases. Although no upper limit is placed on the cooling start temperature, the cooling start temperature is preferably 950° C. or less.

Ar3 transformation point can be calculated using the following formula:

$$Ar3\ (^\circ\ C.)=910-273\times C-74\times Mn-57\times Ni-16\times Cr-9\times Mo-5\times Cu$$

where each element symbol in the formula represents the content of the corresponding element in mass %, with the content of each element not contained being 0.

Cooling Stop Temperature: Mf Point or Less

If the cooling stop temperature is more than Mf point, the volume fraction of martensite cannot be increased sufficiently, and the desired hardness cannot be achieved. Moreover, if the cooling stop temperature is more than Mf point, a difference in hardness occurs in the transverse direction, so that the wide bending workability decreases. The cooling stop temperature is therefore Mf point or less. The cooling stop temperature is preferably (Mf point−100° C.) or less, more preferably (Mf point−120° C.) or less, and further preferably (Mf point−150° C.) or less, from the viewpoint of increasing the volume fraction of martensite. Although no lower limit is placed on the cooling stop temperature, the cooling stop temperature is preferably room temperature or more because excessive cooling leads to lower production efficiency.

Mf point can be calculated using the following formula:

$$Mf\ (^\circ\ C.)=410.5-407.3\times C-7.3\times Si-37.8\times Mn-20.5\times Cu-19.5\times Ni-19.8\times Cr-4.5\times Mo$$

where each element symbol in the formula represents the content of the corresponding element in mass %, with the content of each element not contained being 0.

(b) Reheating Quenching (RQ)

In the case of performing the quenching by reheating quenching, first, the hot-rolled steel plate after the hot rolling is cooled, and the hot-rolled steel plate after the cooling is reheated to a reheating temperature that is Ac3 transformation point or more and 950° C. or less. The hot-rolled steel plate after the reheating is then cooled from the reheating temperature to a cooling stop temperature that is Mf point or less.

Reheating Temperature: Ac3 Transformation Point or More and 950° C. Or Less

Reheating the hot-rolled steel plate to Ac3 transformation point or more can make the microstructure austenite, so that martensite microstructure can be obtained by the subsequent quenching (cooling). If the reheating temperature is less than Ac3 transformation point, ferrite forms and the steel plate is not sufficiently quenched, and consequently the hardness of the steel plate cannot be sufficiently improved. This causes a decrease in the abrasion resistance of the finally obtained steel plate. The reheating temperature is therefore Ac3 transformation point or more. If the reheating start temperature is more than 950° C., crystal grains coarsen and the workability decreases. The reheating temperature is therefore 950° C. or less. To start the cooling from the reheating temperature, for example, the cooling is started immediately after the hot-rolled steel plate is discharged from the furnace used for the reheating.

Cooling Stop Temperature: Mf Point or Less

If the cooling stop temperature is more than Mf point, the volume fraction of martensite cannot be increased sufficiently, and the desired hardness cannot be achieved. Moreover, if the cooling stop temperature is more than Mf point, a difference in hardness occurs in the transverse direction, so that the wide bending workability decreases. The cooling stop temperature is therefore Mf point or less. The cooling stop temperature is preferably (Mf point−100° C.) or less, more preferably (Mf point−120° C.) or less, and further preferably (Mf point−150° C.) or less, from the viewpoint of increasing the volume fraction of martensite. Although no lower limit is placed on the cooling stop temperature, the cooling stop temperature is preferably room temperature or more because excessive cooling leads to lower production efficiency.

(Average Cooling Rate During Quenching)

The cooling rate in the cooling process in the quenching is not limited, and may be any cooling rate with which martensite phase forms. For example, the average cooling rate from the cooling start to the cooling stop is preferably 10° C./s or more, more preferably 15° C./s or more, and further preferably 20° C./s or more. Since a higher average cooling rate is better in principle, no upper limit is placed on the average cooling rate. However, given that a higher cooling rate requires a cooling line capable of cooling at the cooling rate, the average cooling rate is preferably 150° C./s or less, more preferably 100° C./s or less, and further preferably 80° C./s or less. The average cooling rate herein denotes the average cooling rate of the surface temperature at the center position of the steel plate in the transverse direction. The surface temperature can be measured using a radiation thermometer or the like.

(Cooling Rate Difference)

In the present disclosure, in the cooling process in the quenching, the difference in average cooling rate between the center position and the ¼ position of the hot-rolled steel plate in the transverse direction and the difference in average cooling rate between the center position and the ¾ position of the hot-rolled steel plate in the transverse direction are each 5° C./s or less. If the difference in average cooling rate (hereafter also referred to as "cooling rate difference") is more than 5° C./s, the difference in Vickers hardness between adjacent two points is more than 30Hv10, and the wide bending workability degrades. The average cooling rate herein denotes the average cooling rate of the surface temperature of the steel plate. The surface temperature can be measured using a radiation thermometer or the like.

(Tempering)

In one embodiment of the present disclosure, the quenched hot-rolled steel plate may be optionally further subjected to tempering. The tempering can further improve the uniformity of the hardness of the steel plate. In the case of performing the tempering, the cooling stop temperature in the quenching is preferably less than (Mf point−100° C.). After stopping the cooling at the cooling stop temperature, the steel plate is heated to the below-described tempering temperature.

Tempering Temperature: (Mf Point−80° C.) or More and (Mf Point+50° C.) or Less

If the tempering temperature is less than (Mf point−80° C.), the tempering effect cannot be achieved. Accordingly, in the case of performing the tempering, the tempering temperature is (Mf point−80° C.) or more, preferably (Mf point−60° C.) or more, and more preferably (Mf point−50° C.) or more. If the tempering temperature is more than (Mf point+50° C.), the surface hardness decreases noticeably. Accordingly, in the case of performing the tempering, the tempering temperature is (Mf point+50° C.) or less, preferably (Mf point+30° C.) or less, and more preferably (Mf point+10° C.) or less.

Temperature Holding

After the tempering temperature is reached, the heating can be stopped. In one embodiment of the present disclosure, however, after the heating to the tempering temperature, the steel plate may be held at the tempering temperature for any holding time. The holding time is not limited, but is preferably 60 sec or more and more preferably 5 min or more from the viewpoint of enhancing the tempering effect. If the holding time is excessively long, the hardness of the steel plate may decrease. Accordingly, in the case of performing the temperature holding, the holding time is preferably 60 min or less, more preferably 30 min or less, and further preferably 20 min or less.

Heating Rate

The heating rate to the tempering temperature in the tempering is not limited. The average heating rate to the tempering temperature is preferably 0.1° C./s or more and more preferably 0.5° C./s or more, from the viewpoint of productivity. If the average heating rate is 2° C./s or more, carbide precipitates finely, with it being possible to further improve the wide bending workability. Hence, the average heating rate is preferably 2° C./s or more and more preferably 10° C./s or more, from the viewpoint of further improving the wide bending workability. Although no upper limit is placed on the average heating rate, an excessively high heating rate requires a larger line for reheating and also causes an increase in energy consumption. The average heating rate is therefore preferably 30° C./s or less, and more preferably 25° C./s or less.

The heating in the tempering is not limited, and may be performed by any method. For example, at least one method selected from the group consisting of heating using a heat treatment furnace, high frequency induction heating, and electrical resistance heating may be used. In the case of performing the temperature holding, it is preferable to perform the reheating and the temperature holding using a heat treatment furnace. In the case where the average heating rate is 2° C./s or more, it is preferable to perform the heating to the tempering temperature by high frequency induction heating or electrical resistance heating. In the case of using the heat treatment furnace, the average heating rate is preferably 10° C./s or less. The tempering may be performed either offline or online.

After heating to the tempering temperature and optionally holding the temperature, the heating or the temperature holding is stopped. The subsequent cooling method is not limited, and may be one or both of air cooling and water cooling. In one embodiment of the present disclosure, after stopping the heating or the temperature holding, the steel plate may be allowed to naturally cool to room temperature.

In another embodiment of the present disclosure, the cooling in the quenching is stopped in a specific temperature range, and then air cooling is performed. The steel plate is thus tempered, so that the uniformity of the hardness of the steel plate can be further improved as in the case of performing the tempering in the foregoing embodiment. This embodiment will be described below.

Cooling Stop Temperature: Mf Point or Less and (Mf Point−100° C.) or More

If the cooling stop temperature in the quenching is more than Mf point, the volume fraction of martensite cannot be increased sufficiently and the desired hardness cannot be achieved, as mentioned above. Moreover, if the cooling stop temperature is more than Mf point, a difference in hardness occurs in the transverse direction, so that the wide bending workability decreases. The cooling stop temperature is therefore Mf point or less. If the cooling stop temperature is less than (Mf point−100° C.), the tempering effect cannot be achieved even when air cooling is performed after the cooling stop. Hence, in this embodiment, the cooling stop temperature is (Mf point−100° C.) or more. The cooling stop temperature is preferably (Mf point−80° C.) or more and more preferably (Mf point−50° C.) or more, from the viewpoint of enhancing the tempering effect by air cooling.

In this embodiment, the tempering effect can be achieved by performing air cooling after stopping the cooling at the cooling stop temperature. The air cooling is not limited and may be performed under any conditions, but the cooling rate is preferably 1° C./s or less.

EXAMPLES

To demonstrate the effects of the presently disclosed techniques, abrasion-resistant steel plates were produced by the procedure described below and their properties were evaluated.

First, molten steels having the chemical compositions listed in Table 1 were produced through smelting, and steel slabs as steel materials were obtained. Each obtained steel slab was heated to the heating temperature shown in Table 2, and then hot rolled under the conditions shown in Table 2 to obtain a hot-rolled steel plate. The obtained hot-rolled steel plate was subjected to direct quenching or reheating quenching under the conditions shown in Table 2, to produce an abrasion-resistant steel plate. In some examples, after the quenching, tempering was performed under the conditions shown in Table 2. In each example without tempering, after the quenching stop, air cooling was performed at a cooling rate of 1° C./s or less.

The column "cooling rate difference" in Table 2 shows the larger value out of the difference in average cooling rate between the center position and the ¼ position of the hot-rolled steel plate in the transverse direction and the difference in average cooling rate between the center position and the ¾ position of the hot-rolled steel plate in the transverse direction in the cooling process in the quenching.

For each obtained abrasion-resistant steel plate, the volume fraction of martensite (M), the hardness, the maximum transverse direction hardness difference, and the wide bending radius were evaluated. The evaluation methods are as follows.

(Volume Fraction of Martensite)

A sample was collected from each steel plate so that a position of 1 mm in depth from the surface of the steel plate would be the observation position. The surface of the sample was mirror polished and further nital etched, and then a range of 10 mm×10 mm was photographed using a scanning electron microscope (SEM). The captured image was analyzed using an image analyzer to determine the area fraction of martensite. Ten observation fields were observed at random, and the average value of the obtained area fractions was taken to be the volume fraction of martensite.

(Surface Hardness)

A hardness measurement test piece was collected from each obtained abrasion-resistant steel plate, and the Brinell hardness was measured in accordance with JIS Z 2243 (1998). To exclude the influence of scale and a decarburized layer present at the surface of the abrasion-resistant steel plate, the measurement was performed after removing a region from the steel plate surface to a depth of 1 mm by grinding. Hence, the measured hardness was the hardness in a plane of 1 mm in depth from the steel plate surface. The measurement position in the transverse direction was a position of ¼ of the plate width (i.e., ¼ position in the transverse direction). In the measurement, a tungsten hard ball of 10 mm in diameter was used, and the load was 3000 kgf.

(Transverse Direction Hardness Difference)

The Vickers hardness at a depth of 1 mm from the surface of each abrasion-resistant steel plate was measured at intervals of 10 mm in the transverse direction. In the measurement, a region of 50 mm on each end of the transverse direction of the abrasion-resistant steel plate was excluded from the measurement range. From the obtained values, the absolute difference in Vickers hardness between adjacent two points was calculated. The maximum value of the absolute differences is shown in Table 3. The test load in the measurement of the Vickers hardness was 10 kg.

(Limit Bending Radius)

A bending test piece of 200 mm in width and 300 mm in length was collected from each obtained steel plate, and a bending test with a bending angle of 180° was conducted in accordance with JIS Z 2248. From the minimum bending radius R (mm) without cracking and the plate thickness t (mm) in the bending test, the limit bending radius R/t was calculated.

The evaluation results obtained by these methods are listed in Table 3. As can be understood from the results in Table 3, each abrasion-resistant steel plate satisfying the conditions according to the present disclosure had a surface hardness of 500 HBW 10/3000 to 650 HBW 10/3000 in Brinell hardness and was excellent in abrasion resistance. Each abrasion-resistant steel plate satisfying the conditions according to the present disclosure also had a limit bending radius R/t of 7.0 or less in the bending test, exhibiting favorable wide bending workability. Thus, each abrasion-resistant steel plate according to the present disclosure was excellent in both abrasion resistance and wide bending workability. These results demonstrate that the presently disclosed techniques can improve the wide bending workability without a decrease in the surface hardness of the abrasion-resistant steel plate.

TABLE 1

| Steel sample | Chemical composition (mass %) * | | | | | | | | | | | |
|---|---|---|---|---|---|---|---|---|---|---|---|---|
| ID | C | Si | Mn | P | S | Al | Cr | N | Nb | Ti | B | Cu |
| A | 0.310 | 0.36 | 0.82 | 0.006 | 0.0008 | 0.038 | 0.56 | 0.0035 | 0.012 | 0.012 | 0.0010 | — |
| B | 0.326 | 0.77 | 1.12 | 0.005 | 0.0023 | 0.043 | 0.44 | 0.0045 | — | 0.008 | — | 0.25 |
| C | 0.332 | 0.32 | 0.86 | 0.003 | 0.0006 | 0.025 | 0.81 | 0.0029 | 0.015 | 0.013 | 0.0012 | — |
| D | 0.343 | 0.24 | 1.08 | 0.006 | 0.0005 | 0.030 | 0.52 | 0.0036 | 0.013 | — | 0.0013 | — |
| E | 0.369 | 0.82 | 0.95 | 0.006 | 0.0006 | 0.025 | 0.45 | 0.0025 | — | — | — | — |
| F | 0.388 | 0.32 | 0.72 | 0.005 | 0.0012 | 0.031 | 0.33 | 0.0032 | 0.018 | 0.015 | 0.0009 | 0.12 |
| G | 0.405 | 0.55 | 0.55 | 0.016 | 0.0071 | 0.053 | 0.85 | 0.0041 | — | 0.008 | 0.0026 | 0.26 |
| H | 0.421 | 0.69 | 0.86 | 0.006 | 0.0006 | 0.023 | 0.77 | 0.0033 | 0.006 | 0.014 | 0.0008 | 0.39 |
| I | 0.445 | 0.07 | 0.72 | 0.004 | 0.0003 | 0.032 | 0.69 | 0.0025 | — | — | — | — |
| J | 0.260 | 0.32 | 0.86 | 0.005 | 0.0012 | 0.041 | 0.68 | 0.0036 | — | — | — | — |
| K | 0.560 | 0.45 | 0.97 | 0.013 | 0.0027 | 0.035 | 0.20 | 0.0041 | — | — | — | — |
| L | 0.320 | 0.03 | 0.96 | 0.009 | 0.0008 | 0.038 | 0.15 | 0.0036 | 0.012 | — | 0.0010 | — |
| M | 0.336 | 1.33 | 1.03 | 0.006 | 0.0059 | 0.026 | 0.33 | 0.0029 | — | 0.014 | 0.0013 | 0.08 |
| N | 0.432 | 0.33 | 2.48 | 0.009 | 0.0007 | 0.034 | 0.43 | 0.0027 | — | — | — | — |
| O | 0.343 | 0.34 | 0.32 | 0.006 | 0.0022 | 0.045 | 0.32 | 0.0065 | — | — | — | — |
| P | 0.412 | 0.44 | 0.96 | 0.043 | 0.0035 | 0.033 | 0.25 | 0.0048 | — | — | — | — |
| Q | 0.396 | 0.25 | 0.90 | 0.016 | 0.0203 | 0.018 | 0.55 | 0.0086 | 0.009 | 0.015 | 0.0023 | — |
| R | 0.383 | 0.35 | 1.05 | 0.013 | 0.0016 | 0.092 | 0.60 | 0.0032 | — | — | — | — |
| S | 0.392 | 0.26 | 1.13 | 0.010 | 0.0008 | 0.003 | 0.26 | 0.0028 | 0.015 | — | — | 0.33 |
| T | 0.363 | 0.32 | 1.05 | 0.007 | 0.0010 | 0.027 | 1.32 | 0.0041 | 0.013 | — | — | — |
| U | 0.355 | 0.46 | 1.32 | 0.006 | 0.0012 | 0.036 | 0.02 | 0.0032 | — | — | — | — |
| V | 0.343 | 0.27 | 1.61 | 0.015 | 0.0029 | 0.020 | 0.20 | 0.0162 | — | 0.016 | 0.0016 | — |
| W | 0.375 | 0.20 | 1.85 | 0.005 | 0.0008 | 0.035 | 0.35 | 0.0024 | — | — | — | — |

TABLE 1-continued

| Steel sample | Chemical composition (mass %) * | | | | | | | | Ar3 | Ac3 | Mf | |
|---|---|---|---|---|---|---|---|---|---|---|---|---|
| ID | Ni | Mo | V | W | Co | Ca | Mg | REM | (° C.) | (° C.) | (° C.) | Remarks |
| A | — | 0.12 | 0.033 | — | — | 0.0015 | — | — | 755 | 829 | 239 | Conforming steel |
| B | 0.15 | — | — | — | — | — | 0.0030 | — | 721 | 819 | 213 | Conforming steel |
| C | 0.96 | 0.43 | 0.044 | — | 0.22 | — | — | 0.0121 | 684 | 806 | 204 | Conforming steel |
| D | 0.08 | — | 0.028 | 0.32 | — | — | — | — | 724 | 809 | 216 | Conforming steel |
| E | — | — | — | — | — | — | — | — | 732 | 827 | 209 | Conforming steel |
| F | — | 0.16 | 0.015 | — | — | — | — | — | 743 | 811 | 213 | Conforming steel |
| G | — | — | 0.042 | — | — | 0.0022 | — | — | 744 | 802 | 199 | Conforming steel |
| H | — | 0.38 | 0.024 | — | — | — | — | — | 714 | 799 | 177 | Conforming steel |
| I | — | — | — | — | — | — | — | — | 724 | 787 | 188 | Conforming steel |
| J | — | — | — | — | — | — | — | — | 765 | 835 | 256 | Comparative steel |
| K | — | — | 0.015 | — | — | 0.0018 | — | — | 682 | 774 | 139 | Comparative steel |
| L | — | — | — | — | — | — | — | — | 749 | 817 | 241 | Comparative steel |
| M | 0.13 | — | — | — | — | — | — | — | 729 | 845 | 214 | Comparative steel |
| N | 1.28 | 0.26 | — | — | — | — | — | — | 545 | 763 | 131 | Comparative steel |
| O | — | — | — | — | — | — | — | — | 788 | 832 | 250 | Comparative steel |
| P | — | — | — | — | — | — | — | — | 722 | 808 | 198 | Comparative steel |
| Q | — | — | — | — | — | — | — | — | 726 | 802 | 202 | Comparative steel |
| R | — | — | — | — | — | — | — | — | 718 | 804 | 200 | Comparative steel |
| S | 0.36 | — | 0.025 | — | — | — | — | — | 693 | 783 | 187 | Comparative steel |
| T | — | — | — | — | — | — | — | — | 712 | 797 | 194 | Comparative steel |
| U | — | — | — | — | — | — | — | — | 715 | 817 | 212 | Comparative steel |
| V | — | — | — | — | — | 0.0016 | — | — | 694 | 806 | 204 | Comparative steel |
| W | — | — | — | — | — | — | — | — | 665 | 789 | 179 | Example |

* Balance consists of Fe and inevitable impurities.

TABLE 2

| | | | | Hot rolling | | Direct quenching Cooling | | | | | Reheating quenching Cooling | | | Tempering | | | | |
|---|---|---|---|---|---|---|---|---|---|---|---|---|---|---|---|---|---|---|
| No. | Steel sample ID | Steel material Thickness (mm) | Heating Heating temperature (° C.) | Rolling finish temperature (° C.) | Plate thickness (mm) | Cooling start temperature (° C.) | Cooling stop temperature (° C.) | Cooling rate difference (° C./s) | Average cooling rate (° C./s) | Reheating Reheating temperature (° C.) | Cooling stop temperature (° C.) | Cooling rate difference (° C./s) | Average cooling rate (° C./s) | Tempering temperature (° C.) | Heating method | Heating rate (° C./s) | Holding time (min.) | Remarks |
| 1 | A | 250 | 1200 | 850 | 25 | — | — | — | — | 900 | 220 | 1 | 40 | — | — | — | — | Example |
| 2 | B | 250 | 1150 | 850 | 25 | — | — | — | — | 900 | 180 | 2 | 40 | — | — | — | — | Example |
| 3 | C | 250 | 1150 | 850 | 50 | — | — | — | — | 900 | 180 | 1 | 15 | — | — | — | — | Example |
| 4 | D | 250 | 1250 | 750 | 0 | — | — | — | — | 900 | 180 | 3 | 60 | 200 | Heating furnace | 3 | 20 | Example |
| 5 | E | 250 | 1100 | 850 | 25 | 820 | 100 | 2 | 40 | — | — | — | — | — | — | — | — | Example |
| 6 | E | 250 | 1100 | 850 | 25 | 820 | 25 | 3 | 40 | — | — | — | — | 200 | Induction | 8 | 1 | Example |
| 7 | W | 250 | 1100 | 850 | 25 | — | — | — | — | 900 | 100 | 2 | 40 | | | | | Example |
| 8 | F | 250 | 1150 | 900 | 12 | — | — | — | — | 900 | 180 | 3 | 50 | — | — | — | — | Example |
| 9 | F | 250 | 1100 | 900 | 25 | 850 | 180 | 2 | 30 | — | — | I | — | — | — | — | — | Example |
| 10 | F | 250 | 1150 | 850 | 25 | — | — | — | — | 900 | 150 | 2 | 40 | — | — | — | — | Example |
| 11 | G | 250 | 1150 | 900 | 25 | — | — | — | — | 950 | 25 | 2 | 40 | 230 | Induction | 7 | 1 | Example |
| 12 | G | 250 | 1150 | 900 | 25 | — | — | — | — | 950 | 25 | 2 | 40 | — | — | — | — | Example |
| 13 | H | 250 | 1100 | 850 | 60 | — | — | — | — | 900 | 25 | 1 | 15 | — | — | — | — | Example |
| 14 | I | 300 | 1150 | 900 | 50 | — | — | — | — | 900 | 25 | 3 | 20 | 180 | Heating furnace | 5 | 10 | Example |
| 15 | J | 300 | 1200 | 900 | 50 | 800 | 250 | 2 | 20 | — | — | — | — | — | — | — | — | Comparative Example |
| 16 | K | 300 | 1150 | 850 | 40 | — | — | — | — | 900 | 25 | 2 | 20 | — | — | — | — | Comparative Example |
| 17 | L | 200 | 1150 | 900 | 30 | — | — | — | — | 900 | 200 | 2 | 30 | — | — | — | — | Comparative Example |
| 18 | M | 200 | 1150 | 850 | 25 | — | — | — | — | 950 | 100 | 3 | 40 | — | — | — | — | Comparative Example |
| 19 | N | 250 | 1050 | 750 | 60 | 730 | 100 | 1 | 15 | — | — | — | — | — | — | — | — | Comparative Example |
| 20 | O | 250 | 1100 | 900 | 60 | 850 | 25 | 3 | 10 | — | — | — | — | — | — | — | — | Comparative Example |
| 21 | P | 250 | 1150 | 900 | 25 | — | — | — | — | 900 | 25 | 3 | — | — | — | — | — | Comparative Example |
| 22 | Q | 250 | 1050 | 900 | 25 | 850 | 180 | 3 | 40 | — | — | — | — | — | — | — | — | Comparative Example |
| 23 | R | 250 | 1100 | 900 | 25 | — | — | — | — | 900 | 150 | 3 | 40 | — | — | — | — | Comparative Example |
| 24 | S | 250 | 1100 | 850 | 25 | — | — | — | — | 900 | 150 | 2 | 30 | — | — | — | — | Comparative Example |
| 25 | T | 300 | 1100 | 850 | 25 | — | — | — | — | 900 | 150 | 2 | 30 | — | — | — | — | Comparative Example |
| 26 | U | 300 | 1100 | 850 | 25 | — | — | — | — | 900 | 180 | 2 | 30 | — | — | — | — | Comparative Example |
| 27 | V | 300 | 1100 | 800 | 25 | — | — | — | — | 900 | 100 | 2 | 30 | — | — | — | — | Comparative Example |
| 28 | E | 250 | 1100 | 800 | 25 | 700 | 150 | 2 | 30 | — | — | — | — | — | — | — | — | Comparative Example |
| 29 | E | 250 | 1100 | 850 | 25 | 800 | 250 | 2 | 30 | — | — | — | — | — | — | — | — | Comparative Example |
| 30 | E | 250 | 1150 | 900 | 25 | — | — | — | — | 800 | 200 | 2 | 40 | — | — | — | — | Comparative Example |
| 31 | E | 250 | 1150 | 850 | 25 | — | — | — | — | 850 | 300 | — | — | — | — | — | — | Comparative Example |
| 32 | E | 250 | 1100 | 850 | 25 | 800 | 200 | 10 | 40 | — | — | — | — | — | — | — | — | Comparative Example |
| 33 | E | 250 | 1150 | 900 | 25 | — | — | — | — | 900 | 200 | 10 | 40 | — | — | — | — | Comparative Example |

TABLE 3

| No. | Measurement results: Hardness (HBW 10/3000) | Volume fraction of M (%) | Hardness difference (HV10) | R/t | Remarks |
|---|---|---|---|---|---|
| 1 | 512 | 90 | 13 | 4.0 | Example |
| 2 | 532 | 90 | 18 | 4.5 | Example |
| 3 | 567 | 90 | 8 | 4.5 | Example |
| 4 | 575 | 95 | 18 | 4.5 | Example |
| 5 | 583 | 95 | 14 | 5.0 | Example |
| 6 | 545 | 95 | 8 | 4.5 | Example |
| 7 | 560 | 95 | 10 | 5.0 | Example |
| 8 | 601 | 90 | 15 | 6.0 | Example |
| 9 | 603 | 90 | 12 | 6.0 | Example |
| 10 | 598 | 90 | 13 | 5.5 | Example |
| 11 | 612 | 95 | 12 | 6.0 | Example |
| 12 | 608 | 95 | 15 | 6.0 | Example |
| 13 | 625 | 95 | 7 | 6.5 | Example |
| 14 | 644 | 95 | 22 | 6.5 | Example |
| 15 | 485 | 90 | 15 | 4.5 | Comparative Example |
| 16 | 703 | 95 | 15 | 8.0 | Comparative Example |
| 17 | 531 | 90 | 18 | 7.5 | Comparative Example |
| 18 | 556 | 90 | 25 | 7.5 | Comparative Example |
| 19 | 670 | 90 | 25 | 7.5 | Comparative Example |
| 20 | 485 | 80 | 35 | 7.5 | Comparative Example |
| 21 | 605 | 90 | 22 | 8.0 | Comparative Example |
| 22 | 603 | 90 | 23 | 8.0 | Comparative Example |
| 23 | 582 | 90 | 26 | 7.5 | Comparative Example |
| 24 | 593 | 90 | 19 | 8.0 | Comparative Example |
| 25 | 575 | 90 | 16 | 7.5 | Comparative Example |
| 26 | 485 | 90 | 15 | 4.0 | Comparative Example |
| 27 | 546 | 90 | 12 | 7.5 | Comparative Example |
| 28 | 481 | 65 | 105 | 8.5 | Comparative Example |
| 29 | 476 | 70 | 91 | 7.5 | Comparative Example |
| 30 | 489 | 70 | 84 | 7.5 | Comparative Example |
| 31 | 478 | 70 | 80 | 7.5 | Comparative Example |
| 32 | 592 | 90 | 85 | 8.0 | Comparative Example |
| 33 | 603 | 90 | 105 | 8.5 | Comparative Example |

The invention claimed is:

1. An abrasion-resistant steel plate comprising a chemical composition containing, in mass %, C: more than 0.30% and 0.45% or less, Si: 0.05% to 1.00%, Mn: 0.50% to 2.00%, P: 0.020% or less, S: 0.010% or less, Al: 0.01% to 0.06%, Cr: 0.10% to 1.00%, and N: 0.0100% or less, with a balance consisting of Fe and inevitable impurities, wherein a volume fraction of martensite at a depth of 1 mm from a surface of the abrasion-resistant steel plate is 90% or more, hardness at a depth of 1 mm from the surface is 500 HBW 10/3000 to 650 HBW 10/3000 in Brinell hardness, a width of the abrasion-resistant steel plate is 200 mm or more, and a transverse direction hardness difference is 30Hv10 or less in Vickers hardness, the transverse direction hardness difference being defined as a difference in the hardness at a depth of 1 mm from the surface between two points adjacent at intervals of 10 mm in a transverse direction of the abrasion-resistant steel plate.

2. The abrasion-resistant steel plate according to claim 1, wherein the chemical composition further contains, in mass %, at least one of the groups consisting of a) one or more selected from the group consisting of Nb: 0.005% to 0.020%, Ti: 0.005% to 0.020%, and B: 0.0003% to 0.0030%, b) one or more selected from the group consisting of Cu: 0.01% to 0.5%, Ni: 0.01% to 3.0%, Mo: 0.1% to 1.0%, V: 0.01% to 0.10%, W: 0.01% to 0.5%, and Co: 0.01% to 0.5%, and c) one or more selected from the group consisting of Ca: 0.0005% to 0.0050%, Mg: 0.0005% to 0.0100%, and REM: 0.0005% to 0.0200%.

3. A method of producing an abrasion-resistant steel plate, the method comprising:

heating a steel material to a heating temperature that is an Ac3 transformation point or more and 1300° C. or less, the steel material having a chemical composition containing, in mass %, C: more than 0.30% and 0.45% or less, Si: 0.05% to 1.00%, Mn: 0.50% to 2.00%, P: 0.020% or less, S: 0.010% or less, Al: 0.01% to 0.06%, Cr: 0.10% to 1.00%, and N: 0.0100% or less, with a balance consisting of Fe and inevitable impurities;

hot rolling the heated steel material to obtain a hot-rolled steel plate; and subjecting the hot-rolled steel plate to quenching, wherein the quenching is (a) direct quenching of cooling the hot-rolled steel plate from a cooling start temperature that is an Ar3 transformation point or more to a cooling stop temperature that is a Mf point or less or (b) reheating quenching of cooling the hot-rolled steel plate, reheating the cooled hot-rolled steel plate to a reheating temperature that is the Ac3 transformation point or more and 950° C. or less, and cooling the reheated hot-rolled steel plate from the reheating temperature to a cooling stop temperature that is the Mf point or less, and in a cooling process in the quenching, a difference in average cooling rate between a center position and a ¼ position of the hot-rolled steel plate in the transverse direction and a difference in average cooling rate between the center position and a ¾ position of the hot-rolled steel plate in the transverse direction are each 5° C./s or less, thereby producing the abrasion-resistant steel plate wherein a volume fraction of martensite at a depth of 1 mm from a surface of the abrasion-resistant steel plate is 90% or more, hardness at a depth of 1 mm from the surface is 500 HBW 10/3000 to 650 HBW 10/3000 in Brinell hardness, a width of the abrasion-resistant steel plate is 200 mm or more, and a transverse direction hardness difference is 30Hv10 or less in Vickers hardness, the transverse direction hardness difference being defined as a difference in the hardness at a depth of 1 mm from the surface between two points adjacent at intervals of 10 mm in a transverse direction of the abrasion-resistant steel plate.

4. The method of producing an abrasion-resistant steel plate according to claim 3, wherein the cooling stop temperature in the quenching is less than (Mf point−100° C.), and the method comprises, after the quenching, tempering the quenched hot-rolled steel plate at a tempering temperature that is (Mf point−80° C.) or more and (Mf point+50° C.) or less.

5. The method of producing an abrasion-resistant steel plate according to claim 4, wherein in the tempering, the quenched hot-rolled steel plate is held at the tempering temperature for 60 s or more.

6. The method of producing an abrasion-resistant steel plate according to claim 4, wherein an average heating rate in the tempering is 2° C./s or more.

7. The method of producing an abrasion-resistant steel plate according to claim 4, wherein the chemical composition further contains, in mass %, at least one of the groups consisting of a) one or more selected from the group consisting of
Nb: 0.005% to 0.020%,
Ti: 0.005% to 0.020%, and
B: 0.0003% to 0.0030%, b) one or more selected from the group consisting of
Cu: 0.01% to 0.5%,
Ni: 0.01% to 3.0%,
Mo: 0.1% to 1.0%,
V: 0.01% to 0.10%,
W: 0.01% to 0.5%, and
Co: 0.01% to 0.5%, and c) one or more selected from the group consisting of
Ca: 0.0005% to 0.0050%,
Mg: 0.0005% to 0.0100%, and
REM: 0.0005% to 0.0200%.

8. The method of producing an abrasion-resistant steel plate according to claim 3, wherein the cooling stop temperature in the quenching is Mf point or less and (Mf point−100° C.) or more, and the method comprises, after the quenching, air cooling the quenched hot-rolled steel plate.

9. The method of producing an abrasion-resistant steel plate according to claim 8, wherein the chemical composition further contains, in mass %, at least one of the groups consisting of a) one or more selected from the group consisting of
Nb: 0.005% to 0.020%,
Ti: 0.005% to 0.020%, and
B: 0.0003% to 0.0030%, b) one or more selected from the group consisting of
Cu: 0.01% to 0.5%,
Ni: 0.01% to 3.0%,
Mo: 0.1% to 1.0%,
V: 0.01% to 0.10%,
W: 0.01% to 0.5%, and
Co: 0.01% to 0.5%, and c) one or more selected from the group consisting of
Ca: 0.0005% to 0.0050%,
Mg: 0.0005% to 0.0100%, and
REM: 0.0005% to 0.0200%.

10. The method of producing an abrasion-resistant steel plate according to claim 3, wherein the chemical composition further contains, in mass %, at least one of the groups consisting of a) one or more selected from the group consisting of
Nb: 0.005% to 0.020%,
Ti: 0.005% to 0.020%, and
B: 0.0003% to 0.0030%, b) one or more selected from the group consisting of
Cu: 0.01% to 0.5%,
Ni: 0.01% to 3.0%,
Mo: 0.1% to 1.0%,
V: 0.01% to 0.10%,
W: 0.01% to 0.5%, and
Co: 0.01% to 0.5%, and c) one or more selected from the group consisting of
Ca: 0.0005% to 0.0050%,
Mg: 0.0005% to 0.0100%, and
REM: 0.0005% to 0.0200%.

* * * * *